US011617464B2

(12) United States Patent
Jones

(10) Patent No.: US 11,617,464 B2
(45) Date of Patent: Apr. 4, 2023

(54) GARMENT HANGER

(71) Applicant: Mainetti (UK) Ltd, Jedburgh (GB)

(72) Inventor: Michael Jones, Ruthin (GB)

(73) Assignee: Mainetti (UK) Ltd

( * ) Notice: Subject to any disclaimer, the term of this patent is extended or adjusted under 35 U.S.C. 154(b) by 119 days.

(21) Appl. No.: 17/255,319

(22) PCT Filed: Jun. 27, 2019

(86) PCT No.: PCT/GB2019/051811
§ 371 (c)(1),
(2) Date: Dec. 22, 2020

(87) PCT Pub. No.: WO2020/002916
PCT Pub. Date: Jan. 2, 2020

(65) Prior Publication Data

US 2021/0267396 A1 Sep. 2, 2021

(30) Foreign Application Priority Data

Jun. 27, 2018 (GB) ..... 1810560

(51) Int. Cl.
*A47G 25/14* (2006.01)
*A47G 25/34* (2006.01)
*A47G 25/40* (2006.01)

(52) U.S. Cl.
CPC ..... *A47G 25/1428* (2013.01); *A47G 25/34* (2013.01); *A47G 25/40* (2013.01)

(58) Field of Classification Search
CPC .... A47G 25/1428; A47G 25/34; A47G 25/40; A47G 25/14; A47G 25/1435
See application file for complete search history.

(56) References Cited

U.S. PATENT DOCUMENTS

| | | | | |
|---|---|---|---|---|
| 2,166,492 | A | 7/1939 | Harvey | |
| 2,941,704 | A | 6/1960 | Slutzky | |
| 3,870,206 | A | 3/1975 | Feinberg | |
| 5,183,190 | A | 2/1993 | Zuckerman | |
| 7,731,068 | B2 * | 6/2010 | Scicluna | A47G 25/32 223/91 |
| 7,837,074 | B2 * | 11/2010 | Rude | A47G 25/32 223/94 |
| 8,113,393 | B2 * | 2/2012 | Ho | A47G 25/183 223/92 |
| 9,113,736 | B1 * | 8/2015 | Antler | A47G 25/32 |
| 9,445,679 | B2 * | 9/2016 | Hansen | A47G 25/40 |
| 9,655,466 | B1 * | 5/2017 | Bernstein | A47G 25/1428 |

(Continued)

FOREIGN PATENT DOCUMENTS

EP 3222171 9/2017

*Primary Examiner* — F Griffin Hall

(74) *Attorney, Agent, or Firm* — The Belles Group, P.C.

(57) ABSTRACT

A foldable garment hanger is disclosed which includes a hook which can be folded relative to the garment supporting portion by virtue of a hinge. A size marker is attached to a connecting portion which joins the hook to the garment support portion and includes the hinge. When the size marker straddles the hinge the connecting portion is held rigid thereby fixing the hook relative to the garment support portion. Preferably the size marker is slidable to expose the hinge thereby allowing the hanger to be easily moved between an erect display condition and a folded transportation condition.

6 Claims, 7 Drawing Sheets

(56) References Cited

U.S. PATENT DOCUMENTS

| | | | | |
|---|---|---|---|---|
| 9,820,599 | B1 * | 11/2017 | Goldman | A47G 25/1428 |
| 10,111,544 | B1 * | 10/2018 | Bernstein | A47G 25/32 |
| 2007/0062984 | A1 * | 3/2007 | Louw | A47G 25/1428<br>223/85 |

* cited by examiner

GARMENT HANGER

CROSS-REFERENCE TO RELATED PATENT APPLICATIONS

The present application is a U.S. national stage application under 35 U.S.C. § 371 of PCT Application No. PCT/GB2019/051811, filed Jun. 27, 2019, which claims priority to United Kingdom Patent Application No. 1810560.1, filed Jun. 27, 2018. The disclosures of the aforementioned priority applications are incorporated herein by reference in their entireties.

The present invention relates to a garment hanger, and relates particularly, but not exclusively, to a box packed ship-on hanger.

It is commonplace for garments, which are displayed on hangers in a retail store, to be transported from their manufacturer to the retailer already hung on a hanger. Hangers designed for this purpose are referred to as "ship-on hangers". This is done by transporting the hanger and garment hung on a rail but this has the disadvantage that it is inefficient in the space that it takes up within a shipping container as the garments cannot be packed very close together. It is therefore becoming increasingly popular to ship garments on hangers in boxes as this is much more space efficient. However, in order to effectively ship as many garments and hangers as possible within a box it is preferable to have a hanger with a hook which is able to fold thereby reducing the volume defined by the external edges of the hanger. An example of such a hanger is disclosed in our earlier International patent application published under the number WO 2017/068344.

Other mechanisms for producing a folding hanger include the use of live hinges in a hanger formed as a single injection moulding. However, such hangers have the disadvantage that the live hinge makes the junction between the hook and the remainder of the hanger loose or slack which is undesirable and ultimately weakens the hinge.

Preferred embodiments of the present invention seek to overcome or alleviate the above described disadvantages of the prior art.

According to an aspect of the present invention there is provided a garment hanger comprising:— a body including,

- a suspension portion for suspending the hanger from a rail,
- a garment support portion for supporting a garment thereon,
- a connecting portion connecting said suspension and garment support portions and including a first connection portion connected to said suspension portion, a second connection portion connected to said garment support portion and a hinge connected therebetween allowing said suspension portion to fold towards said garment support portion; and a size marker for attachment to said connecting portion, wherein said size marker is movable selectively allowing the hanger to be changed from a transportation condition in which said hinge can move to a display condition in which said suspension portion and said body portion are substantially fixed relative to one another.

By providing a hanger with a connecting portion that includes a live hinge allowing the suspension portion to fold towards the remainder of the hanger and locking this with a size marker the advantage is provided that a low-cost hanger can be provided for boxed ship-on hanger garments where the hinge can be locked. This is particularly useful as a size marker is a commonly used component in a hanger and does not add significantly to the cost. Furthermore, by fixing the hinge into a static position, the hinged does not move and hinges that are prone to becoming weaker through use, for example live hinges which rely on using thin material to create the flexibility, have their use significantly limited thereby decreasing the likelihood of the end becoming weakened.

In a preferred embodiment in the transportation condition said size marker is engaged only with one of said first and second connection portions and in said display condition said size marker is engaged with both said first and second connection portions.

This arrangement allows the size marker to slide over the hinge thereby converting from the transportation condition to the display condition. Thus it is possible for the size marker to be attached to the hanger during production of the hanger thereby ensuring that the hanger is used correctly. As a result, the only action required when the box of garments is unpacked is to move the hook from the folded position, that is the transportation condition, and to slide the size marker over the hinge thereby transforming to the display condition.

In another preferred embodiment in the transportation condition said size marker is not engaged with said body and in said display condition said size marker is engaged with both said first and second connection portions.

This arrangement allows for a snap-on/snap-off size marker to be used.

The first and second connection portions may be moulded as a single component with said hinge comprising a live hinge.

Furthermore the body may be moulded as a single component.

A single component body with a live hinge is a low-cost solution to providing a folding ship on hanger.

In a further preferred embodiment the size marker has a uniform cross-section.

Having a size marker of the uniform cross-section allows the size marker to be produced by extrusion and also helps to facilitate the sliding motion of the size marker in the switching from the transportation to display conditions.

The hinge may comprise a double hinge.

By providing a double hinge the advantage is provided that the suspension portion is able to fold over against the garment supporting portion whilst accommodating the thickness of the front face of the size marker without putting undue strain on to the hinge.

Preferred embodiments of the present invention will now be described, by way of example only, and not in any limitative sense with reference to the accompanying drawings in which:—

Figure 1:
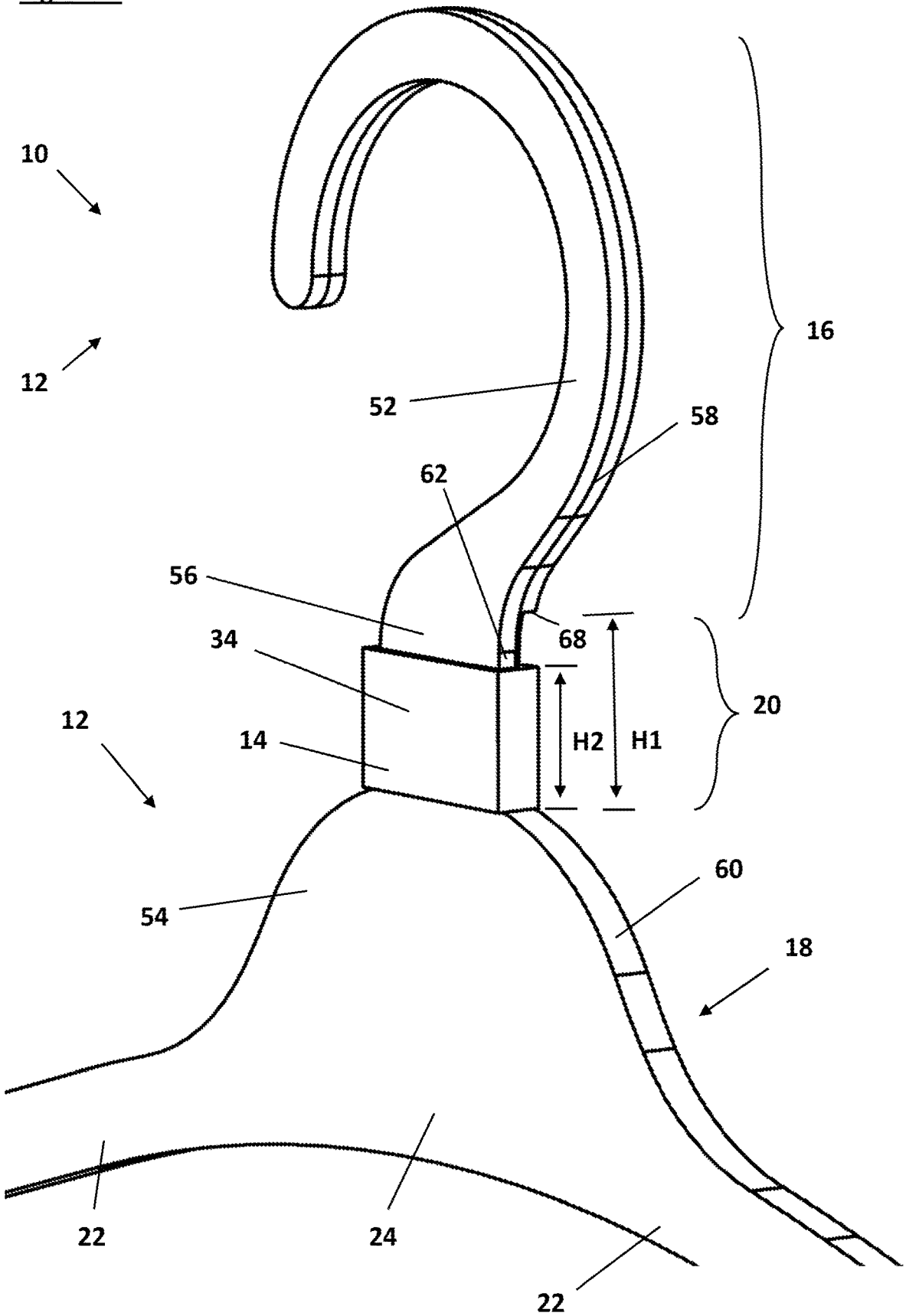
FIGS. 1 and 2 is a perspective views of a portion of a hanger of the present invention showing a size marker in different positions.

Referring to FIGS. 1 to 13, a hanger 10 is formed as two separate, and preferably separable, components in the form of a body, generally indicated at 12, and a size marker 14.

The body 12 is formed as a single component and can be divided into a suspension portion, in the form of a hook 16, a garment support portion in the form of a hanger body 18, and a connecting portion 20 which is located between the hook 16 and body 18. The hook 16 is provided to allow the garment hanger, and the garment (not shown) hung thereon, to be suspended from a rail (also not shown). The body 18 is provided to support a garment and in the embodiment shown in FIGS. 1 and 5 to 12 is a so-called tops hanger used for hanging garments such as shirts, T-shirts, blouses and other lightweight garments worn on the upper portions of a person's body. The body 18 of the hanger 10 has a pair of arms 22 extending in approximately opposite directions from a central label area 24. Typically, the label area is printed, or has a sticker stuck thereto, bearing information such as a brand of the retailer or garment manufacturer or other useful information which might attract a potential retail customer for the garment on the hanger.

The connecting portion 20 is located between the hook 16 and hanger body 18 and is provided with a hinge 26 which allows the hook 16 to be folded towards the body 18 as shown in FIGS. 6 to 13 and particularly, FIGS. 8 to 11. The hinge 26 is a so-called live hinge formed as a thinning of the plastic material from which the body portion 12 of hanger 10 is formed in a manner familiar to person skilled in the art. The hinge 26 comprises a pair of live hinges 28 and 30 with a rib of thicker material 32 located therebetween.

Figure 3:
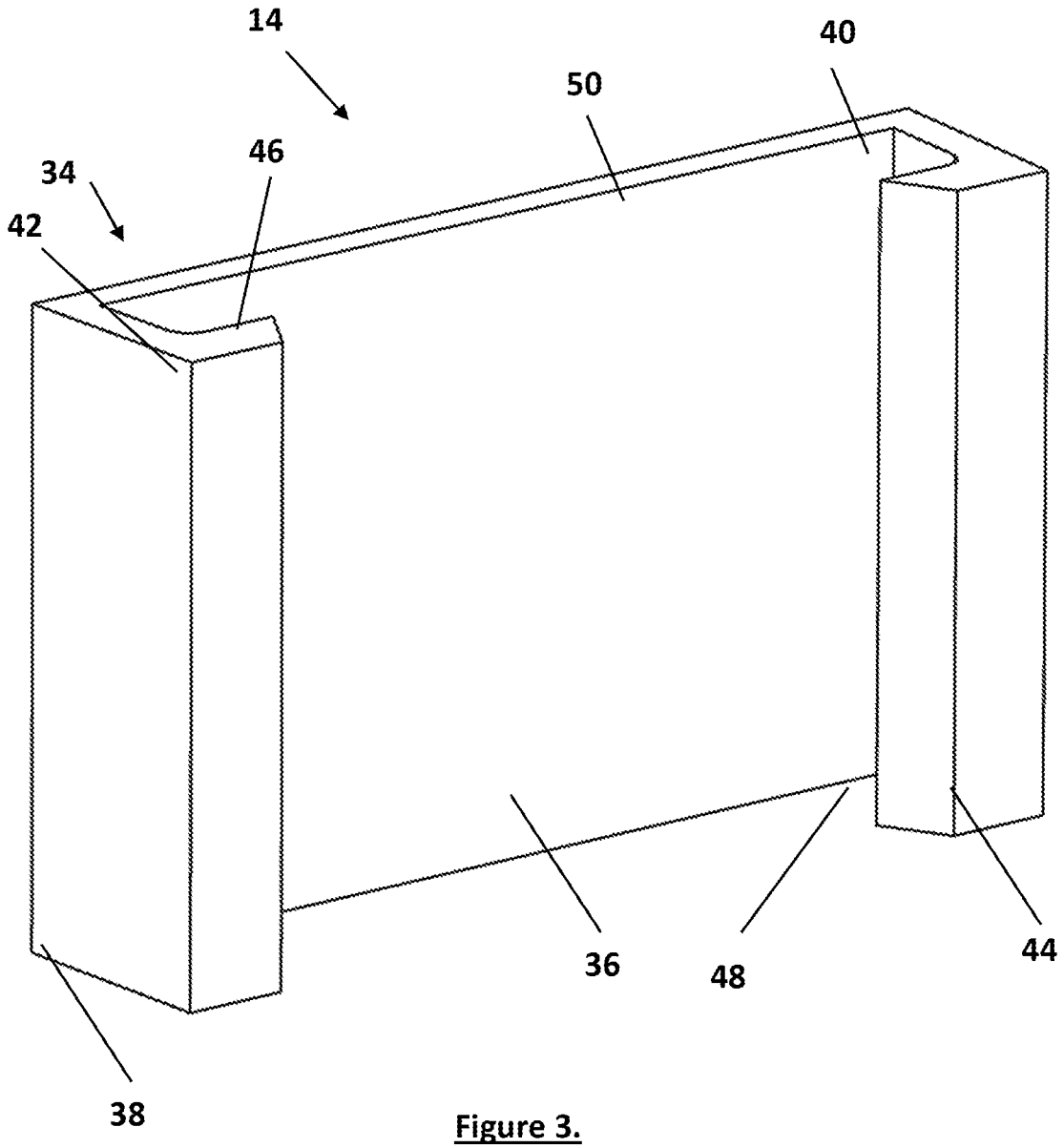
FIG. 3 is a perspective view of a size marker used in the present invention.
Figure 5:
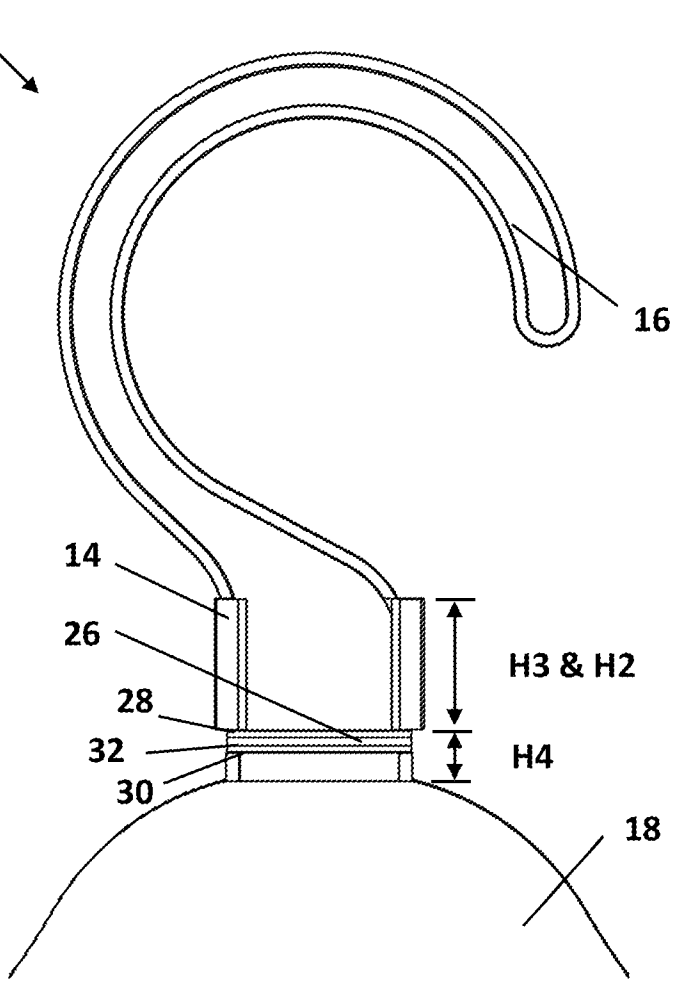
FIGS. 4 and 5 are rear views of a portion of the hanger of FIGS. 1 and 2.
Figure 4:
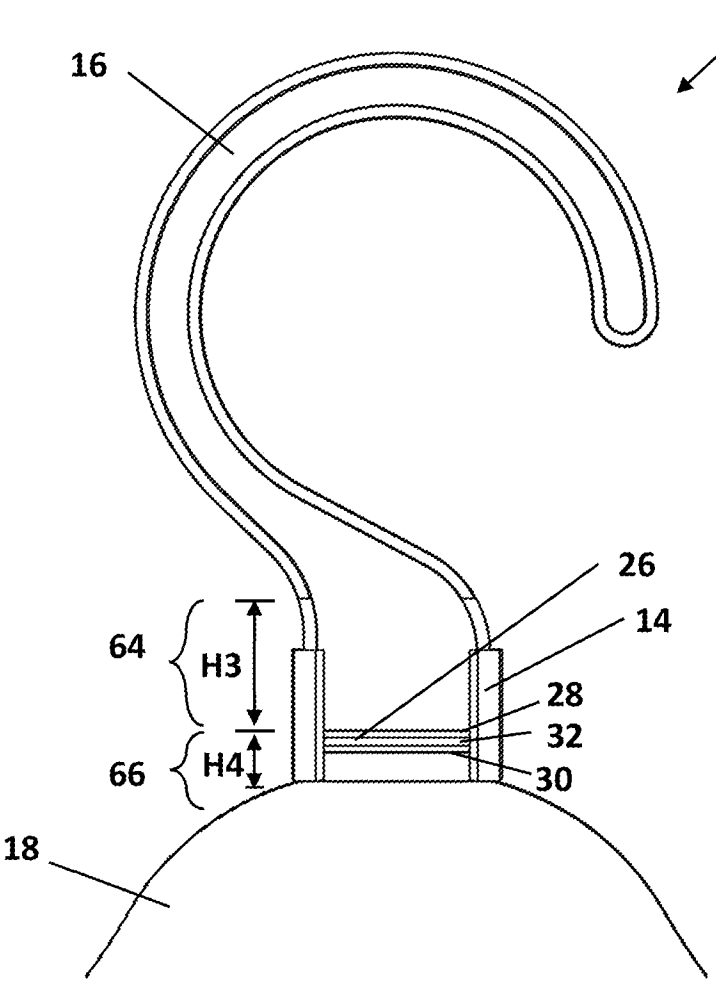
Figure 7:
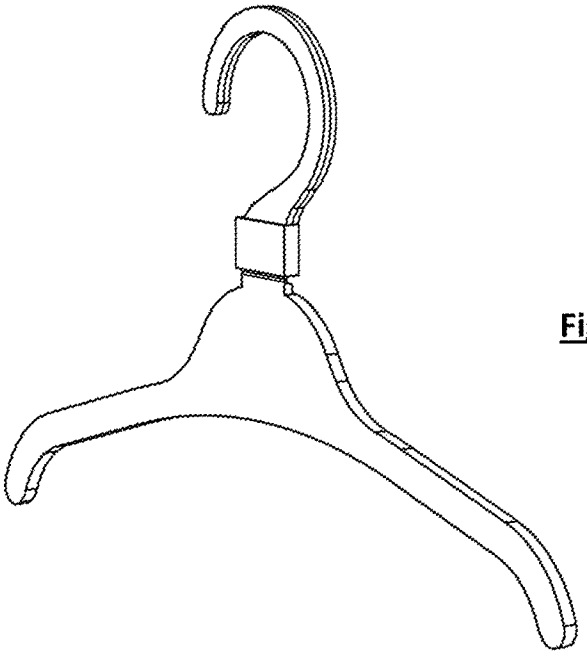
FIGS. 6 to 13 are perspective views of the hanger of FIG. 1 illustrating the stages of the operation of the hanger of FIGS. 1 and 2.

Referring particularly to FIG. 3, the size marker 14 is provided to display information most typically relating to the size of the garment hung on the hanger 12. This information is printed onto the front planar surface 34 of a main wall 36. A pair of sidewalls 38 and 40 extend perpendicularly from the main wall 34 and terminate in ends 42 and 44 which in turn extend perpendicularly, and therefore towards each other, from the sidewalls 38 and 40. The ends 42 and 44 have chamfered faces 46 and 48 which face away from the rear surface 50 of the main wall 36. As can be seen from FIG. 3, the size marker 14 has a uniform cross-section and this therefore allows the size marker to be produced by extrusion and chopping to create the required size.

As is familiar to person skilled in the art, it is commonplace to form the body portion 12 with a cross-section which strengthens the weight-bearing parts of the hanger 10. Typically for hangers where the hook and body portion are formed in a single injection moulding, these cross sections are known as an I-cross-section and a C-cross-section and in the example shown in the figures it is the latter type which is shown. In order to create the C-cross-section the hook 16, body 18 and connecting portions 20 have front faces which are respectively labelled 52, 54 and 56. Extending from either side of these front faces are sidewalls which are respectively labelled 58, 60 and 62 and it is these sidewalls which create a lot of the rigidity in both the hanger body 18 and the hook 16.

Figure 2:
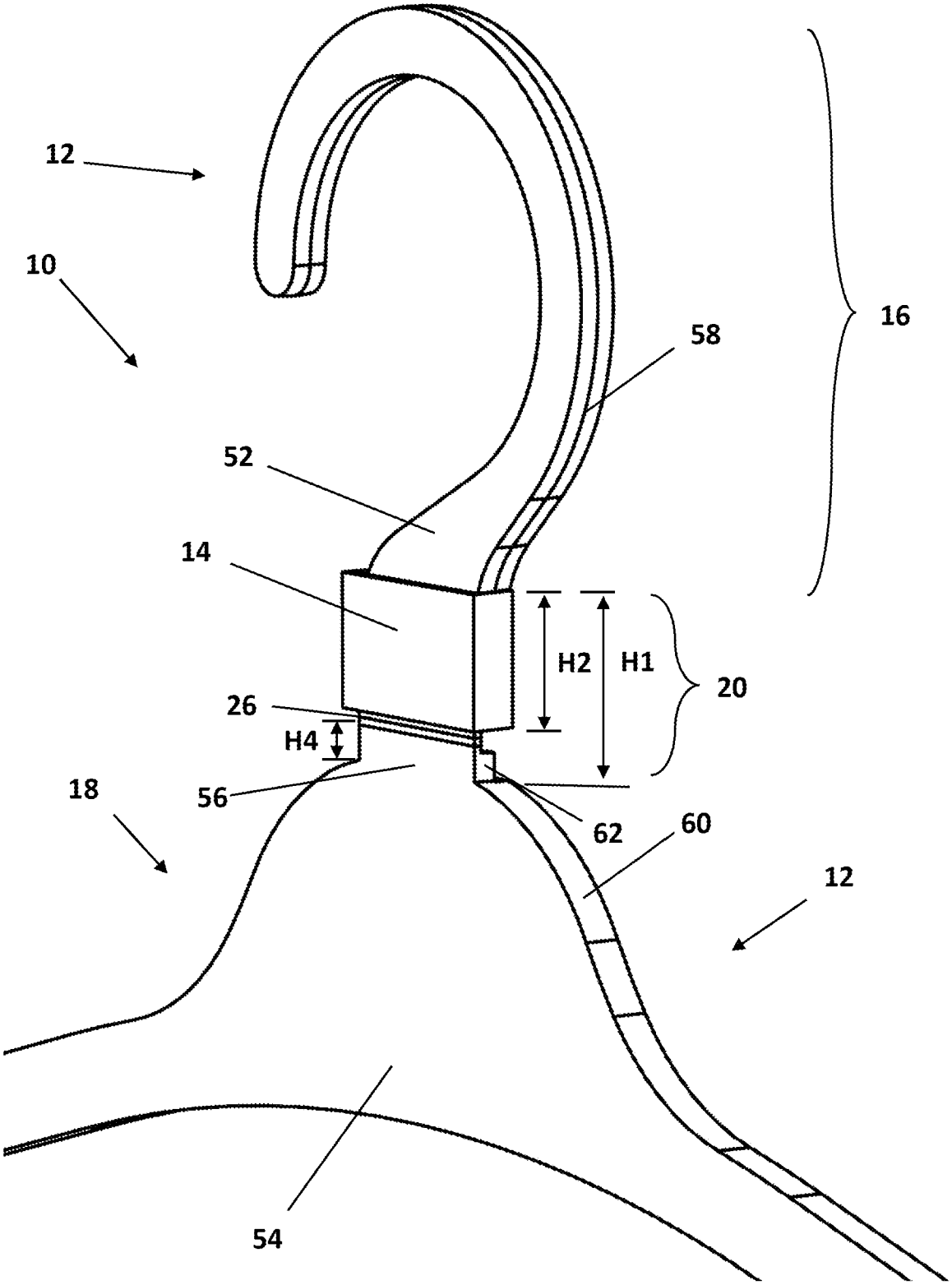

As can be clearly seen in FIGS. 1 and 2, the length of the sidewalls 62 in the connecting portion 20 is less than the sidewalls 58 and 60 in the hook 16 and hanger body 18. Specifically, the length of the sidewalls 62 is approximately the same as the inner surface of the sidewalls 38 and 40 of the size marker 14 measured from the rear face 50 of the main wall 36 to the ends 42 and 44. As a result, the size marker 14 fits closely over the connecting portion 20 so that the rear face 50 of the main wall 36 of the size marker 14 engages the front face 56 with the sidewalls 38 and 40 of the size marker 14 extending down the sidewalls 62 of the connecting portions. The ends 42 and 44 then extend round the sidewalls 62 retaining the size marker in place and engaged with the connecting portion.

In order to allow the size marker 14 to slide on the connecting portion 20 the connecting portion has a height H1 which is greater than the height H2 of the size marker. The hinge 26 acts as a divider for the connecting portion 20 separating it into a first connection portion 64 and a second connection portion 66. With the size marker 14 removed the first connection portion 64 appears contiguous with hook 16 and likewise the second connection portion 66 appears contiguous with the body 18. The hinge 26 is located such that the height H3 of the first connection portion 64 is approximately the same as the height H2 of the size marker 14. As a result, the hinge 26 can operate when the size marker 14 is located on the first connection portion 64 of the connecting portion 20. The second connection portion 66 has a height H4 which is less than the height H2 of the size marker.

Operation of the hanger 10 will now be described. The size marker 14 is brought into engagement with the body portion 12 so that the size marker engages the connecting portion 20. This engagement is created by snap fitting the size marker over the sidewalls 62. The chamfered faces 46 and 48 of the ends 42 and 44 help facilitate the size marker 14 expanding by the outward movement of the sidewalls 38 and 42 fit onto the connecting portion 20. If not already in this position, the size marker 14 is slid upwards so that the ends 42 and 44 of the size marker 14 engage an edge, an example of which is indicated at 68, of the sidewalls 58 of the hook 16. Once in this position the hinge 26 is exposed and is able to bend. The use of two hinges 28 and 30 allows for the thickness of the main wall 34 of size marker 14 to be accommodated as the hook 16 rotates through 180° to almost come into engagement with the hanger body 18 (see FIGS. 9 and 10).

Figure 6:
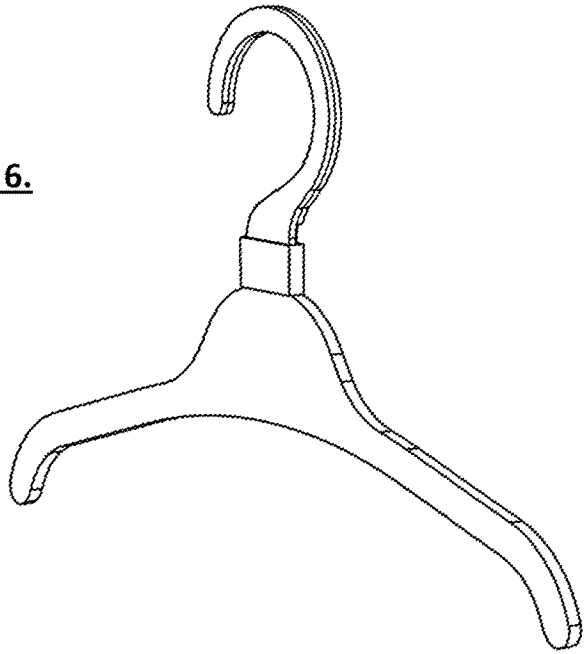
Figure 9:
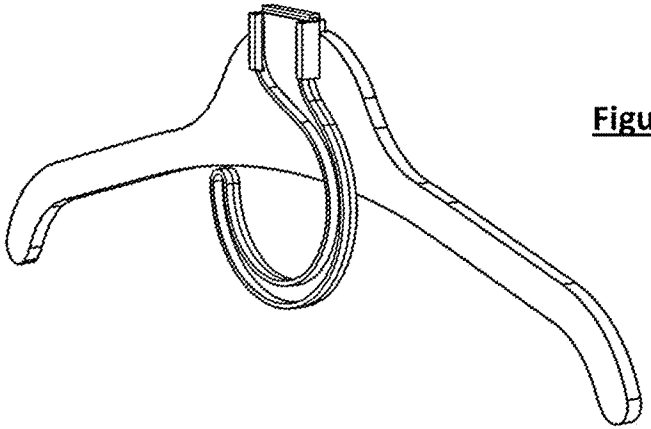
Figure 8:
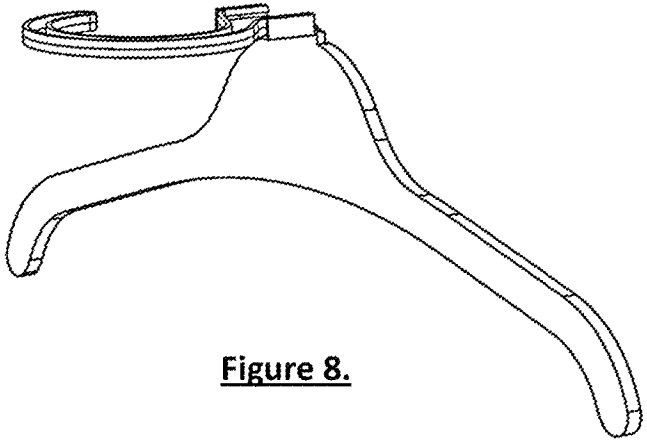
Figure 11:
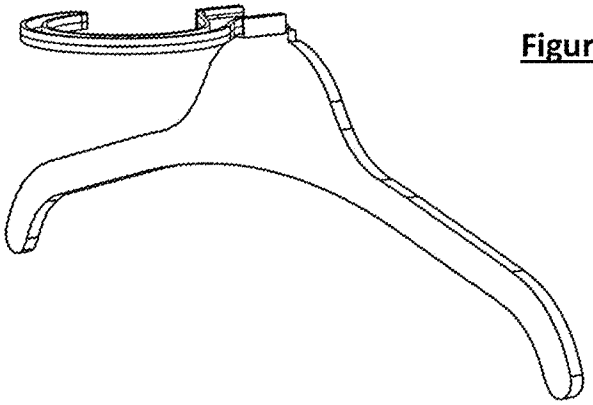
Figure 13:
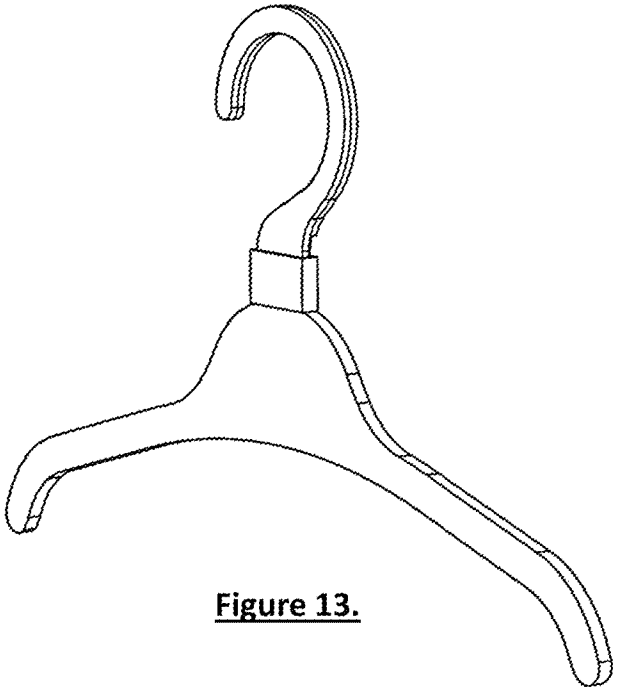
Figure 10:
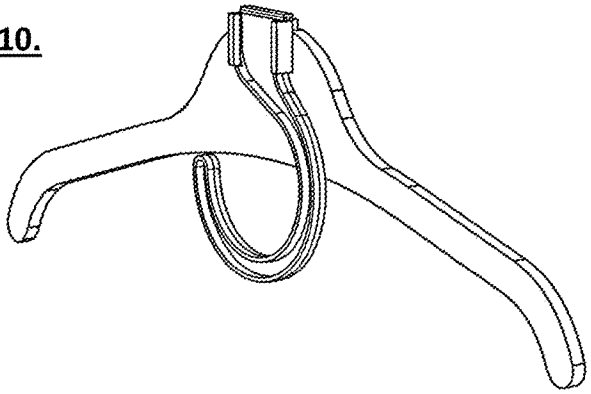

Referring particularly to FIGS. 6 to 13, the hanger 10 of the present invention is able to operate in two conditions and these figures illustrate the transition from one condition to the other. In FIG. 6 the size marker is located so as to engage both the first and second connection portions and therefore straddle the hinge 26. This condition prevents the hinge from being able to bend and is therefore a display condition with the hook in an upright position and substantially unable to fold (without removal or damage of the size marker) and ready to have a garment hung there on to be displayed in a retailer environment. In the second condition the hanger is folded down, as shown in FIGS. 9 and 10, and this condition allows for easy transportation of the hanger, with a garment hung thereon, with both garment and hanger packaged into a box. In order to reach this transportation condition, the size marker 14 is moved upwards so as to entirely engage the first connection portion 64 (see FIG. 7). Once the size marker 14 is in this position, the hinge 26 is able to bend and the hook 16 and first connection portion 64 of the connecting portion 20 can bend forwards through 90° (see FIG. 8) to 180° which is the transportation condition (see FIG. 9).

Figure 12:
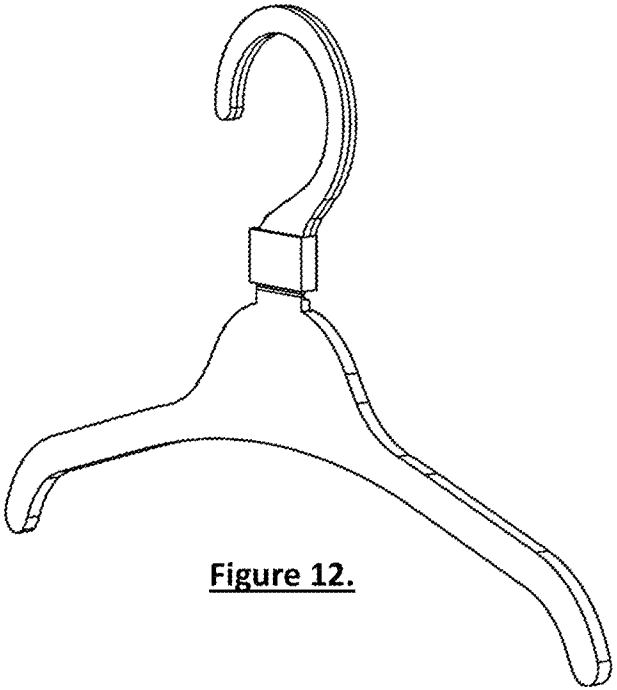

When the garment and hanger arrive and are ready to be displayed on a rail, the hanger is in the same condition (see FIG. 10) and is rotated through 90° (FIG. 11) to become erect as shown in FIG. 12. The size marker is then slid in a downwards direction so as to be partially engaged with the second connection portion 66 which, because it is shorter than the size marker 14, ensures that the size marker straddles the hinge 26 thereby preventing movement of the hinge and returning the hanger 10 to a display condition. The hanger, and garment hung thereon, can now be hung on a rail.

Although not shown in the drawings it is preferable that a portion of one of the sidewalls 62 has a small semi-circular portion extending inwards. This allows that when the size marker 14 is located thereon a small tool can be pushed into a gap between the semi-circular portion and one of the edges 42 or 44 of the size marker to help in the removal of the size marker.

Figure 14:
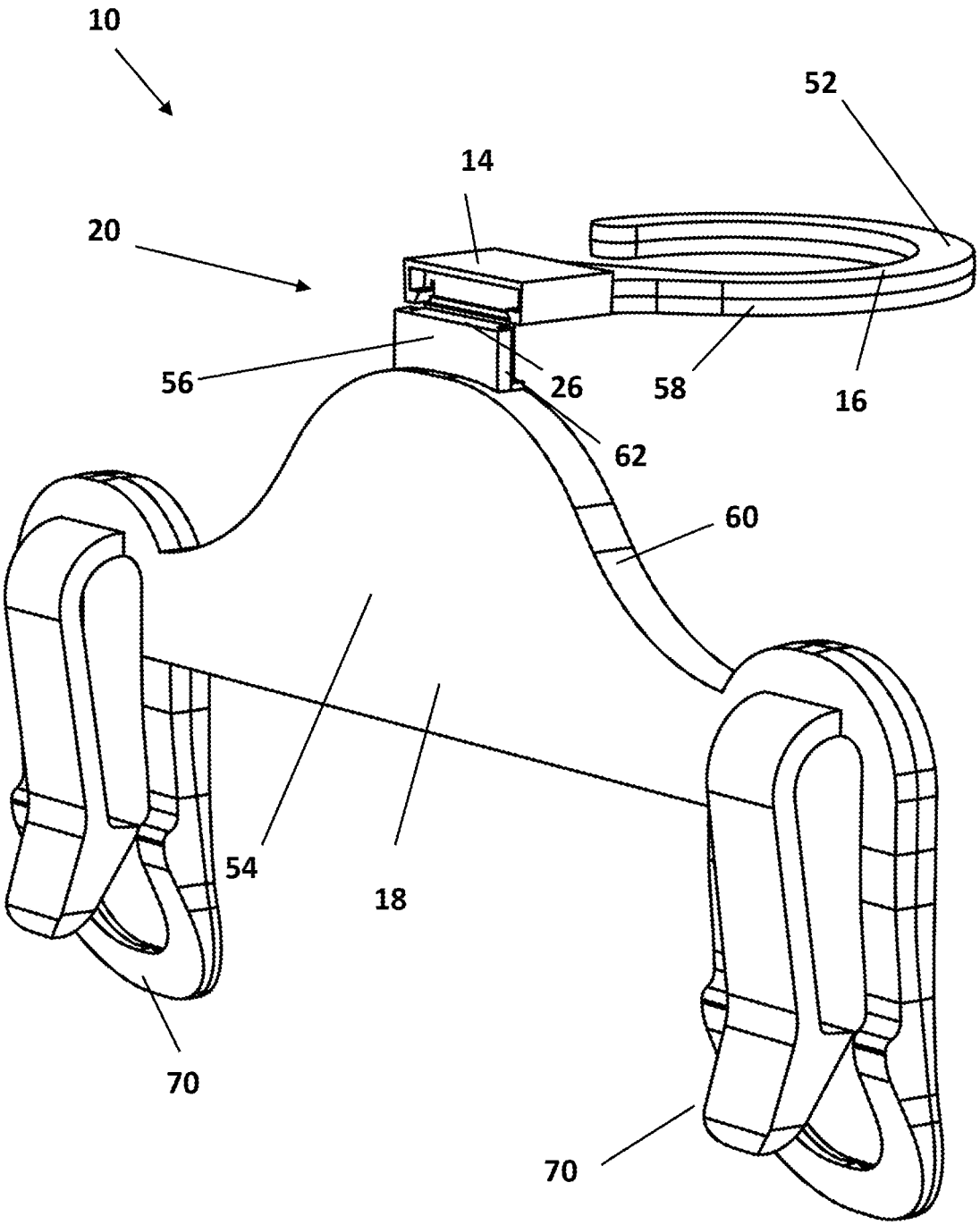
FIG. 14 is a perspective view of an alternative embodiment of a hanger of the present invention.

It will be appreciated by persons skilled in the art that the above embodiments have been described by way of example only and not in any limitative sense, and that various alterations and modifications are possible without departure from the scope of the protection which is defined by the appended claims. For example, the present invention can be used with other types of hanger and an example of this is shown in FIG. 14. This clip hanger is suitable for hanging garments such as trousers. In this example the garment is held by the clips 70 in front of the hanger 10 and it is therefore preferable that the hook folds backwards away from the garment. In order to facilitate this the hinge 26 is located on the rear side of the connecting portion 20. This is in contrast to the tops hanger shown in the other drawings which as a forward folding hook which will therefore enter the space around the net of the garment hung on that hanger.

The present invention can be used with hangers having a different cross-section to that seen in the figures and can also be used with a metal hook which extends into the first connection portion 64 of the connecting portion 20. In another alternative the connecting portion 20 and the size marker 14 could have the same height and be engaged and disengaged by snap fitting although this does have the disadvantage that the transportation condition can only be achieved by removal of the size marker.

The invention claimed is:

1. A garment hanger comprising:

a body including, a suspension portion for suspending the hanger from a rail, a garment support portion for supporting a garment thereon, a connecting portion connecting said suspension and garment support portions and including a first connection portion connected to said suspension portion, a second connection portion connected to said garment support portion and a live hinge connected therebetween allowing said suspension portion to fold towards said garment support portion, wherein said first and second connection portions are moulded as a single component; and a size marker for attachment to said connecting portion, wherein said size marker is movable selectively allowing the hanger to be changed from a transportation condition in which said live hinge can move to a display condition in which said suspension portion and said garment support portion are substantially fixed relative to one another.

2. The garment hanger according to claim 1, wherein in said transportation condition said size marker is engaged only with one of said first and second connection portions and in said display condition said size marker is engaged with both said first and second connection portions.

3. The garment hanger according to claim 1, wherein in said transportation condition said size marker is not engaged with said second connection portion and in said display condition said size marker is engaged with both said first and second connection portions.

4. The garment hanger according to claim 1, wherein said body is moulded as a single component.

5. The garment hanger according to claim 1, wherein said size marker has a uniform cross-section.

6. The garment hanger according to claim 1, wherein said live hinge comprises a double hinge.

* * * * *